US008686862B2

(12) United States Patent
Dunham

(10) Patent No.: US 8,686,862 B2
(45) Date of Patent: Apr. 1, 2014

(54) SYSTEM FOR MONITORING RUNNING STEPS

(75) Inventor: Brady V. Dunham, Layton, UT (US)

(73) Assignee: Midfoot Performance LLC, Layton, UT (US)

( * ) Notice: Subject to any disclaimer, the term of this patent is extended or adjusted under 35 U.S.C. 154(b) by 185 days.

(21) Appl. No.: 13/346,546

(22) Filed: Jan. 9, 2012

(65) Prior Publication Data

US 2013/0176126 A1 Jul. 11, 2013

(51) Int. Cl.
*G08B 23/00* (2006.01)

(52) U.S. Cl.
USPC ..... 340/573.1; 340/286.01; 340/825.36

(58) Field of Classification Search
USPC ..... 340/573.1, 286.01, 323 R, 571, 582, 340/611, 614, 626, 683, 691.6, 825.36, 340/7.55, 7.6, 7.61, 7.62
See application file for complete search history.

(56) References Cited

U.S. PATENT DOCUMENTS

| | | | | |
|---|---|---|---|---|
| 5,615,111 | A | 3/1997 | Raskas et al. | |
| 5,807,283 | A * | 9/1998 | Ng | 600/595 |
| 5,899,963 | A | 5/1999 | Hutchings | |
| 5,955,667 | A | 9/1999 | Fyfe | |
| 6,099,478 | A * | 8/2000 | Aoshima et al. | 600/500 |
| 6,356,856 | B1 | 3/2002 | Damen et al. | |
| 6,851,204 | B2 * | 2/2005 | Aveni et al. | 36/28 |
| 7,171,331 | B2 | 1/2007 | Vock et al. | |
| 7,203,609 | B2 * | 4/2007 | Moritani | 702/65 |
| 7,467,060 | B2 | 12/2008 | Kulach et al. | |
| 7,552,021 | B2 | 6/2009 | Bar-Haim et al. | |
| 7,607,243 | B2 | 10/2009 | Berner, Jr. et al. | |
| 2008/0066343 | A1 | 3/2008 | Sanabria-Hernandez | |
| 2008/0146968 | A1 | 6/2008 | Hanawaka et al. | |
| 2009/0240171 | A1 * | 9/2009 | Morris Bamberg et al. | 600/595 |
| 2010/0063779 | A1 * | 3/2010 | Schrock et al. | 702/188 |
| 2010/0115799 | A1 | 5/2010 | Welter et al. | |
| 2011/0054358 | A1 | 3/2011 | Kim et al. | |
| 2013/0041617 | A1 * | 2/2013 | Pease et al. | 702/139 |

OTHER PUBLICATIONS

International Search Report and Written Opinion dated Apr. 9, 2013, issued in PCT Application No. PCT/US2013/020689, filed Jan. 8, 2013.

* cited by examiner

*Primary Examiner* — Daniel Previl
(74) *Attorney, Agent, or Firm* — Workman Nydegger

(57) ABSTRACT

Systems and methods of monitoring a running step and signaling the runner when a correction is desired. In one aspect, the portion of the foot that contacts the ground first is monitored to determine if a correction is desired. To monitor the running step, a step analyzing apparatus can be used that is positioned within a shoe. The step analyzing apparatus can include sensors that are positioned at the midfoot and the heal when the apparatus is within the shoe. To signal the runner, an indicator can be used that is positioned within the shoe or outside the shoe. The step analyzing apparatus can also be used in a ski boot to monitor proper ski form. Running cadence can also be monitored to determine if a correction is desired.

20 Claims, 11 Drawing Sheets

SYSTEM FOR MONITORING RUNNING STEPS

CROSS-REFERENCE TO RELATED APPLICATIONS

Not applicable.

BACKGROUND OF THE INVENTION

1. The Field of the Invention

The present application generally relates to devices and methods for athletic training More specifically, the present application relates to devices and methods for optimizing foot action during running 2. The Relevant Technology In recent years many individuals have turned to their own fitness program of regular jogging. Jogging has long been recognized for its therapeutic effects on the body. It purportedly increases cardiopulmonary fitness, helps to lower blood pressure, decreases cholesterol and triglyercides associated with heart disease and reduces weight. Jogging is also one of the easiest exercises to do. It requires no athletic ability and can be done almost any time and any place with a minimum of equipment and without assistance.

The popularity of jogging today is well documented by the large numbers of products and literature available to the public. As in many exercise and sporting endeavors, there exists in the prior art a wide variety of devices for aiding those who jog. Many people who jog desire to know their progress over time. For example, many joggers and runners want to know the accurate distance and speed traveled during an exercise session. This information allows a jogger to monitor his or her progress and accordingly pursue a regular course of exercise designed to enhance performance. Conventional systems record the number of steps the jogger takes and provides the jogger with rate and distance information for their period of travel.

In more recent times, many joggers have begun running competitively. As with recreational joggers, competitive runners also desire to know their progress over time. One area that can increase performance and lower running times is improvement in a runners step and stride. The step refers to how the foot contacts and leaves the ground, while the stride refers to the distance and time between steps. While many devices exist for measuring a runner's stride, few devices exist that give information on a runner's step. Yet the manner in which the foot contacts and leaves the ground can greatly affect a runner's performance. For example, according to various experts, for optimal running efficiency and performance, the midfoot of the foot should be the first part of the foot that contacts the ground.

Therefore, it would be an improvement in the art to provide systems and methods for monitoring a running step to help optimize the running step.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope. In the drawings, like numerals designate like elements. Furthermore, multiple instances of an element may each include separate letters appended to the element number. For example two instances of a particular element "20" may be labeled as "20*a*" and "20*b*". In that case, the element label may be used without an appended letter (e.g., "20") to generally refer to every instance of the element; while the element label will include an appended letter (e.g., "20*a*") to refer to a specific instance of the element.

DETAILED DESCRIPTION OF THE PREFERRED EMBODIMENTS

As used in the specification and appended claims, directional terms, such as "top," "bottom," "up," "down," "upper," "lower," "proximal," "distal," and the like are used herein solely to indicate relative directions and are not otherwise intended to limit the scope of the invention or claims.

The term "shoe", as used herein, refers to any type of external covering for the human foot. For example, the term "shoe" can include any type of foot covering typically referred to in the art as a shoe, as well as slippers, boots, flip-flops, sandals, moccasins, and the like. The term "runner", as used herein, can refer to anyone who engages in the act of running As such, the term "runner" encompasses professional runners who run competitively, joggers who run recreationally, and everyone in between. The term "runner" also encompasses those for whom running is not their primary focus. For example, any athlete who runs in the course of training or competing are encompassed by the term "runner" herein. By way of example and not limitation, this can include those involved in basketball, tennis, soccer, volleyball, football, and the like.

The present invention relates to systems and methods of monitoring a running step and signaling the runner when a correction is warranted. In one embodiment, the portion of the foot that contacts the ground first is monitored to determine if a correction is warranted. To do so, a step analyzing apparatus can be used that is positioned within or incorporated into a shoe. The step analyzing apparatus can include sensors that are positioned at the midfoot and the heal when the apparatus is within the shoe. To signal the runner, an indicator can be used that is positioned within the shoe or outside the shoe. In another embodiment, the step analyzing apparatus can be used in a ski boot to monitor proper ski form. In one embodiment, running cadence can be monitored to determine if a correction is warranted.

Figure 1:
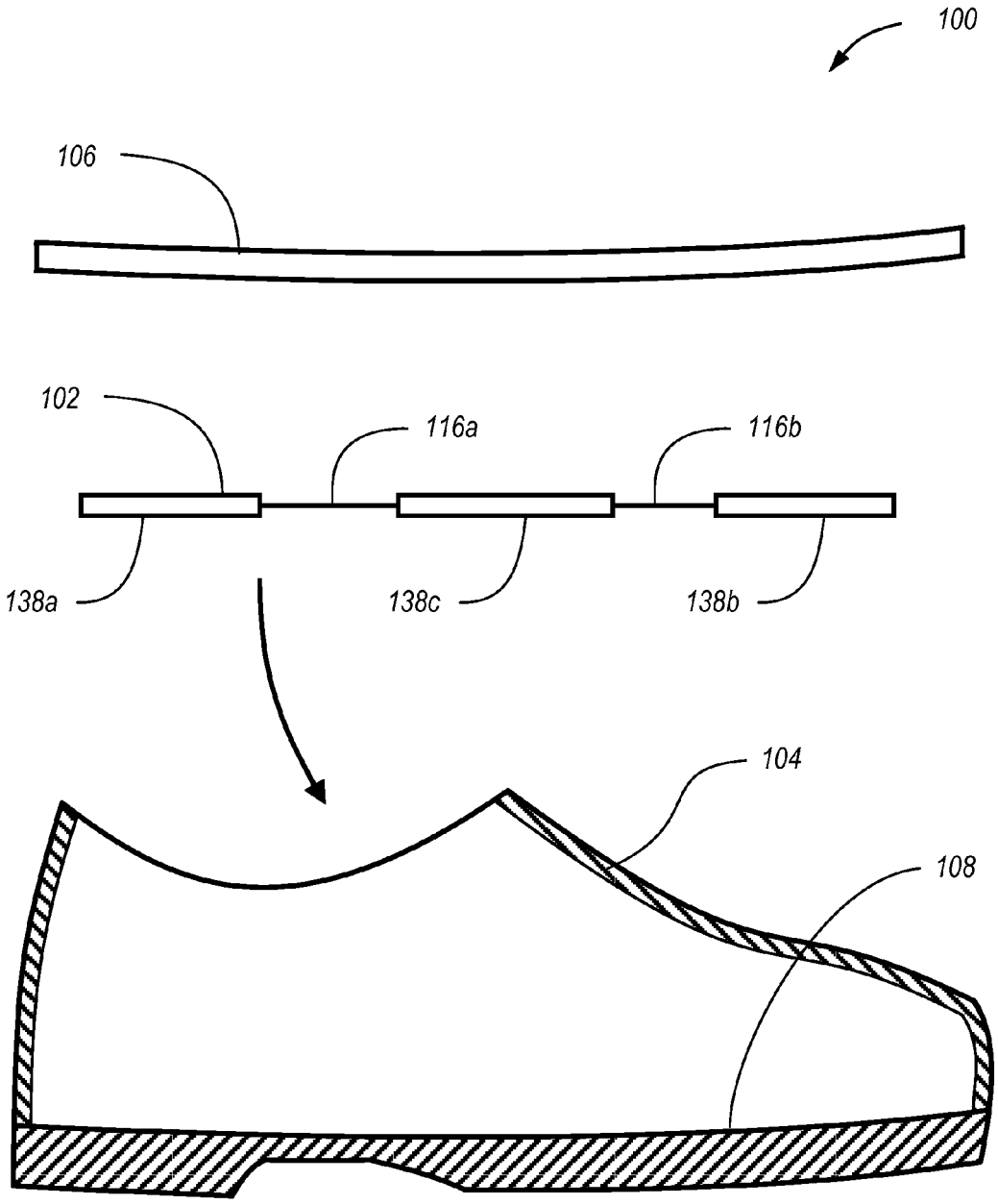
FIG. 1 is an exploded side view of a system for monitoring running steps according to one embodiment.

FIG. 1 is an exploded side view of a system 100 for monitoring running steps according to one embodiment. System 100 includes a step analyzing apparatus 102 that is positionable within a shoe 104 so as to be at least partially disposed under the foot of the shoe wearer. In the depicted embodiment, step analyzing apparatus 102 is positionable under an insole 106 of the shoe. That is, analyzing apparatus 102 is positionable between insole 106 and sole 108 of shoe 104. Insole 106 can be any insole known in the art, or one that is specifically designed for use with step analyzing apparatus 102. If desired, insole 106 can comprise the insole that is sold with the shoe, although this is not required. In the depicted embodiment, step analyzing apparatus 102 is removable from shoe 104. In other embodiments, step analyzing apparatus 102 can be secured to or incorporated into sole 108 or insole 106 of shoe 104. For example, the components of step analyzing apparatus 102 can be secured to sole 108 and/or insole 106 using an adhesive, fasteners, or the like or by being embedded therein.

Figure 2:
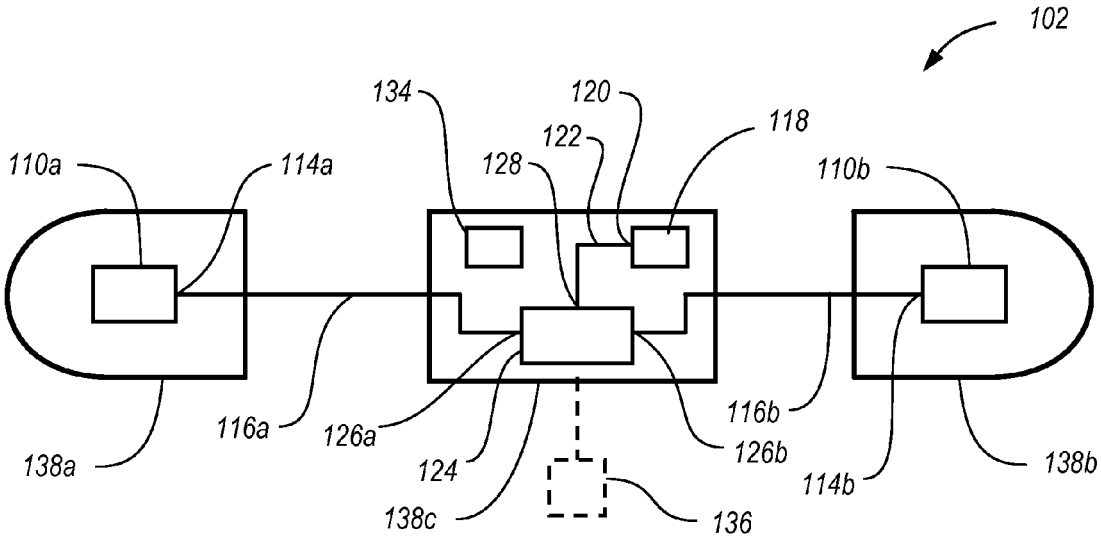
FIG. 2 is a schematic representation of the step analyzing apparatus shown in FIG. 1.

FIG. 2 is a schematic representation of step analyzing apparatus 102. Step analyzing apparatus 102 comprises one or more sensors 110, each configured to measure or detect foot force or pressure thereon. For example, the depicted embodiment includes a first sensor 110*a* and a second sensor 110*b*. Of course, more than two sensors can be incorporated into step analyzing apparatus 102 if desired. During use, sensors 110 are positioned under different portions of a runner's foot to detect when the portion of the shoe associated with the particular portion of the foot contacts a running surface, such as concrete, asphalt, grass, or the like, as discussed in more detail below. Sensors 110 can be positioned under any portion of the foot desired. In one embodiment, first sensor 110*a* and second sensor 110*b* are respectively positioned within shoe 104 (FIG. 1) so as to be under the heel and midfoot of the runner's foot, respectively. The midfoot is commonly referred to as the forefoot and includes but is not limited to the area under the five metatarsal bones. As such, second sensor 110*b* can be located below one or more of the metatarsal bones including the $5^{th}$ metatarsal bone. The sensors can also sized so that they extend beyond being located just under the heel and midfoot.

In some embodiments, sensor 110 can detect when a force or pressure greater than or equal to a predetermined amount is generated thereagainst. The predetermined amount can vary, depending on the shoe type, the runner type, the runner's weight and build, and other factors. For example, sensor 110 can comprise a switch that switches "on" when a force or pressure greater than or equal to a predetermined amount is generated thereagainst, such as a force switch, a pressure switch, or a gravity switch, as is known in the art. Other switches or similar force detection devices, as are presently known in the art or may become known in the art in the future, can also be used.

In some embodiments, sensor 110 can reflect the amount of force or pressure generated thereagainst. For example, sensor 110 can comprise a tactile sensor that senses the amount of force or pressure generated thereagainst, such as a transducer, a force sensor, a pressure sensor, or a strain gauge, as is known in the art. Other tactile sensors or similar force detection devices, as are presently known in the art or may become known in the art in the future, can also be used.

First and second sensors 110*a* and 110*b* can both comprise the same type of sensor or can comprise different types of sensors. Regardless of the type of sensor used, each sensor 110 can have an output port 114 for transmitting a signal indicating the status of the sensor. For example, for switch type sensors, the transmitted signal can indicate the presence or absence of the predetermined amount of force, and for tactile type sensors, the transmitted signal can be indicative of the amount of force or pressure exerted against the sensor. In the depicted embodiment the signals are transmitted by output ports 114 over one or more wires 116. In other embodiments one or more of the signals can be transmitted wirelessly.

Step analyzing apparatus 102 can further comprise an indicator 118 for signaling the runner when certain conditions occur. For example, in one embodiment, indicator 118 can be used to signal the user when it is determined that one or more incorrect steps have occurred. In some embodiments, indicator 118 can be used to signal the user when a predetermined number of correct steps have occurred. Indicator 118 can also be used at other times, if desired, to signal the runner.

Indicator 118 can comprise any type of signaling device that can provide notice to the runner when activated. For example, in one embodiment, indicator 118 can comprise a vibrator, such as a vibrator used in a cellular telephone, that vibrates when activated to provide notice to the runner. Other types of signaling devices can also be used. By way of example and not limitation, besides a vibrator, indicator 118 can comprise an audio device, (e.g. a speaker), a visual display device (e.g., a light, one or more LEDs, or a display screen such as can be hand held, incorporated onto a wrist band, or mounted or formed on a separate structure, such as a treadmill) or any other signaling device that can provide notice to the runner. In some embodiments, more than one type of signaling device can be used.

Depending on the type of signaling device used, indicator 118 can be positioned within the shoe or external to the shoe. For example, when a vibrator is used as indicator 118, the vibrator can be positioned on or under the foot, such as under or adjacent to the arch of the foot, similar to the rest of step analyzing apparatus 102, where the runner will feel the vibration when the vibrator is activated. When an audio or visual display device is used as indicator 118, the device can be positioned on the exterior surface of the shoe or can be positioned at a location remote to the shoe, where the runner is more likely to notice the signal. For example, the audio device could be positioned at or near the ears of the runner, while the visual display device could be positioned on the wrist of the runner or another location where the visual display device would be noticed by the runner, such as, e.g., on the display of a treadmill during indoor workouts. The indicator can also be positioned at other locations.

Indicator 118 includes an activating input port 120 used to activate indicator 118. When an activating signal is received on activating input port 120, indicator 118 can signal the runner. In some embodiments, indicator 118 is always powered on and is activated to signal the runner using a separate control line. In other embodiments, indicator 118 is configured to always be activated whenever power is applied to it. In those embodiments, activating input port 120 can simply comprise providing power to indicator 118.

In the depicted embodiment the signals are received by activating input port 120 over one or more wires 122. In other embodiments, such as when indicator 118 is positioned outside of the shoe, one or more of the signals can be transmitted wirelessly.

Step analyzing apparatus 102 can also comprise a processor 124 in electrical communication with sensors 110 and indicator 118 so as to receive and analyze the signals transmitted by sensors 110 and activate indicator 118 when desired. Processor 124 can have one or more input ports 126 coupled with wires 116 for receiving the signals transmitted by sensors 110. In the depicted embodiment, input ports 126*a* and 126*b* respectively receive the signals transmitted by output ports 114*a* and 114*b* of sensors 110*a* and 110*b* over wires 116*a* and 116*b*. For those embodiments in which a signal is transmitted wirelessly by sensor 110, input ports 126 can be configured to receive the corresponding signal(s) wirelessly.

Similarly, processor 124 can have one or more output ports 128 coupled with wires 122 for transmitting activating signals to indicators 118. For example, in the depicted embodiment, a single output port 128 is used to transmit an activating signal over wires 122 to activating input port 120 of indicator 118. For those embodiments in which the activating signal is received wirelessly by indicator 118, output port 128 can be configured to transmit the corresponding signal wirelessly to indicator 118.

Figure 3:
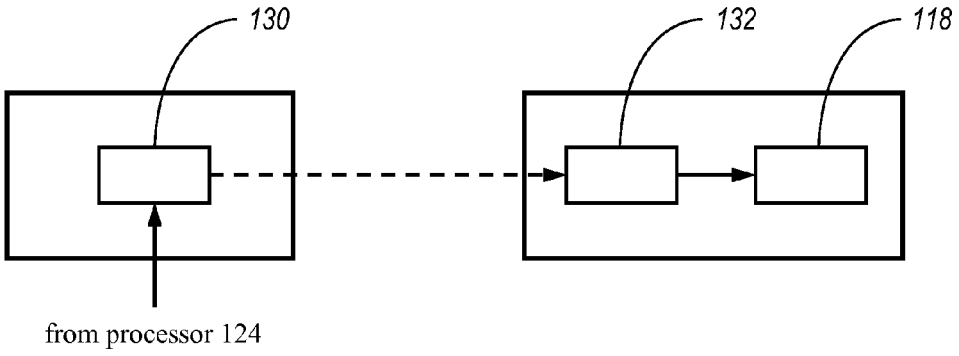
FIG. 3 is a schematic representation of a portion of a step analyzing apparatus according to another embodiment, showing an indicator that is wirelessly coupled to the processor via a transmitter and receiver.

FIG. 3 shows one embodiment in which a transmitter 130 and receiver 132 are used to wirelessly couple processor 124 and indicator 118. Using transmitter 130 and receiver 132, processor 124 can wirelessly send the activating signal to indicator 118. Any type of couplable wireless transmitter and receiver as are now known in the art or that may become known in the art can be used. For example, transmitter 130 and receiver 132 can comprise devices that communicate with each other using RF, infrared, bluetooth, or any other type of wireless transmission system.

Returning to FIG. 2, processor 124 analyzes the signals received at input ports 126 to determine if a correction is warranted in the running step of the runner, and alerts the runner accordingly by transmitting the activating signal to indicator 118 using output 128. Various methods of analyzing the inputs and signaling the user will be discussed in more detail below.

The processes performed by processor 120 can be accomplished using electronic hardware alone, or in conjunction with computer-executable instructions. As such, embodiments of processor 120 may comprise or utilize a special purpose computer having one or more microprocessors and system memory. Embodiments of processor 120 may also include physical storage media and other computer-readable media for storing computer-executable instructions and/or data structures which are used by the one or more computing microprocessors. Such computer-readable media can be any available media that can be accessed by a general purpose or special purpose computer. Computer-readable media that store computer-executable instructions are physical storage media. Computer-readable media that carry computer-executable instructions are transmission media. Thus, by way of example, and not limitation, embodiments of the present invention may comprise at least two distinctly different kinds of computer-readable media: physical storage media and transmission media.

Physical storage media used in embodiments of the present invention may include RAM, ROM, and EEPROM or any other medium which can be used to store desired program code means (i.e., software) in the form of computer-executable instructions or data structures and which can be accessed by the one or more microprocessors of a special purpose computer to implement aspects of the invention, such that they are not merely transitory carrier waves or propagating signals.

Computer-executable instructions comprise, for example, instructions and data which, when executed by one or more microprocessors, cause a general purpose computer, special purpose computer, or special purpose processing device to perform a certain function or group of functions, including the functions described herein, as aspects of the invention. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Remaining with FIG. 2, step analyzing apparatus 102 can include a power source 134, such as a standard or custom battery, to power the components of step analyzing apparatus 102. Step analyzing apparatus 102 can also include a system activator 136, such as a switch or button, to turn analyzing apparatus 102 on and off. System activator 136 can be positioned on the outside of the shoe, where it is more easily accessible, although that is not required. Other power sources and system activators, as are presently known in the art or may become so in the future, can also be used. In some embodiments, step analyzing apparatus 102 can turn on and off automatically, as discussed in more detail below, thereby obviating the need for system activator 136. As a result, system activator 136 can be omitted in those embodiments, if desired.

Portions of step analyzing apparatus 102 discussed above can be mounted on one or more substrates 138 to aid in mounting and positioning step analyzing apparatus 102 within a shoe. For example, in the embodiment depicted in FIGS. 1 and 2, three separate substrates 138*a*, 138*b*, and 138*c* are depicted, respectively corresponding to the heel, the midfoot, and the arch portions of the foot. In the depicted embodiment, first sensor 110*a* is positioned on substrate 138*a* so as to be positioned under the heel, second sensor 110*b* is positioned on substrate 138*b* so as to be positioned under the midfoot, and indicator 118, processor 124, and power source 134 are positioned on substrate 138*c* so as to be positioned between the heel and the midfoot. Wires or other flexible wiring components 116 can be used to pass signals between substrates 138.

Substrates 138 can be comprised of a rigid but more commonly flexible material. Common materials for substrate 138 include fabric, or one or more thin layers of polymeric material, polymeric foam, rubber, silicone, or the like. In some embodiments, one or more of the substrates can form a flexible circuit, as is known in the art, to include circuit traces of step analyzing apparatus 102. To minimize obstruction with the foot, in one embodiment, sensors 110, indicator 118, power source 134, and/or processor 124 can have a maximum thickness extending between a top surface and opposing bottom surface in a range between about 0.5 mm to about 7 mm with about 0.5 mm to about 4 mm being more common. Other dimensions can also be used. Substrates 138 can have the same range of maximum thickness.

Although three separate substrates 138*a*-138*c* are shown in the depicted embodiment, it is appreciated that more or less substrates can alternatively be used. For example, in some embodiments, sensors 110*a* and 110*b*, indicator 118, processor 124, and power source 134 are all positioned on a single substrate. In other embodiments, substrates 138*a* and 138*c* can be combined or substrates 138*b* and 138*c* can be combined. In one embodiment, the insole or some other portion of the shoe can act as substrate(s) 138 for step analyzing apparatus 102 and substrate(s) 138 can be omitted, as discussed in more detail below. In some embodiments, one or more of the components of step analyzing apparatus 102 may be standalone units that are not mounted on any substrate. If desired, an adhesive can be applied to substrates 138 and/or the different components of analyzing apparatus 102 for securing to a shoe or other structure. For example, substrates 138 and/or the different components of analyzing apparatus 102 can be provided with a peel off layer on one side that covers an adhesive until use.

Figure 4:
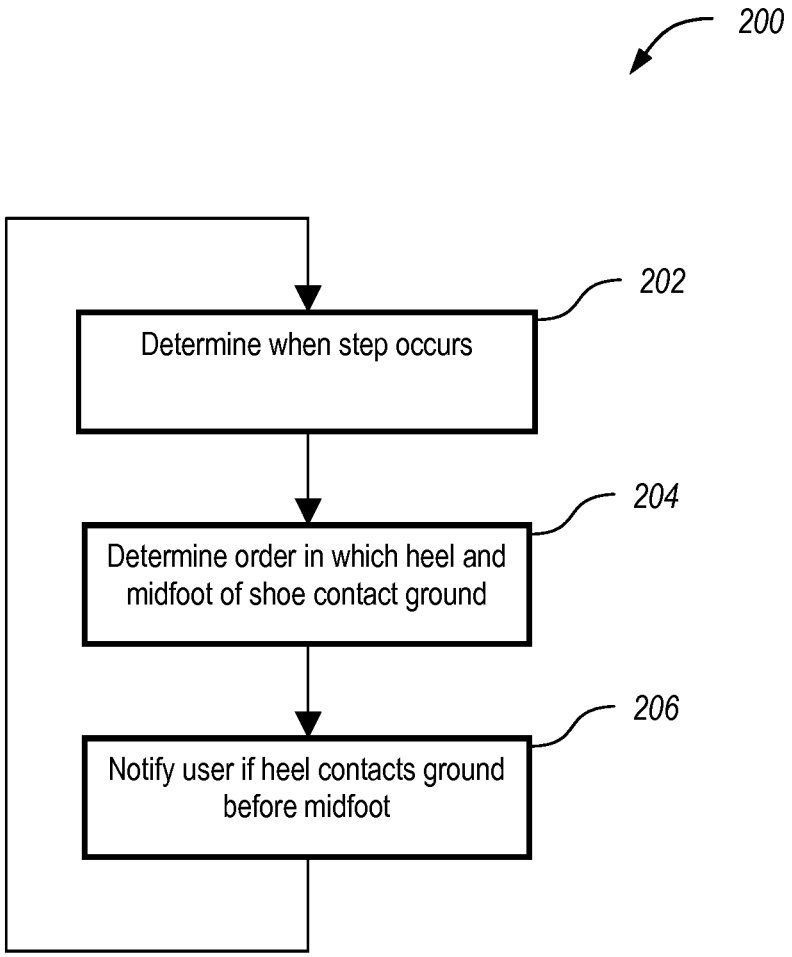
FIG. 4 is a block diagram of a method of monitoring running steps according to one embodiment.
Figure 5:
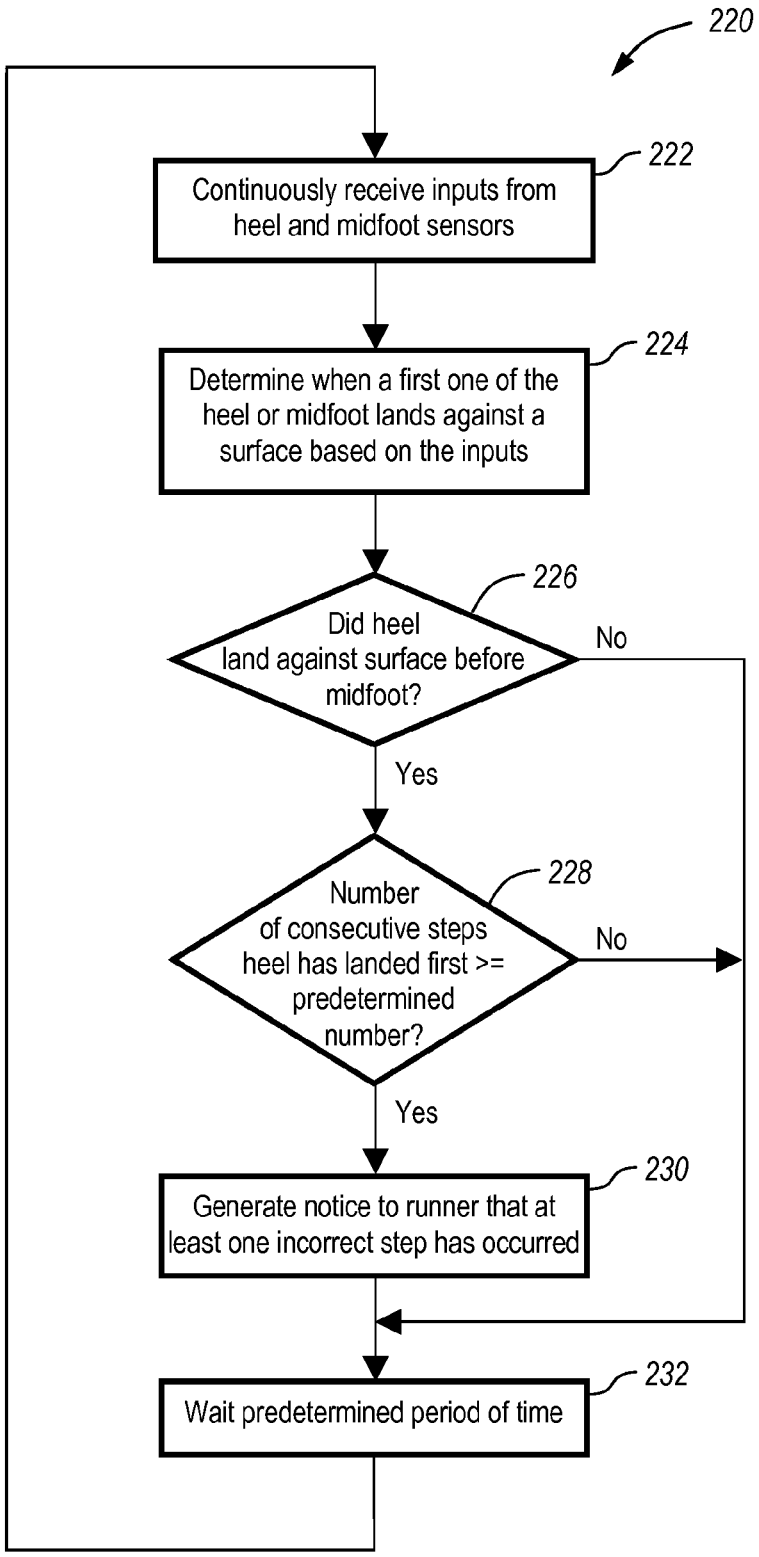
FIG. 5 is a block diagram of a method of monitoring running steps according to another embodiment.
Figure 6:
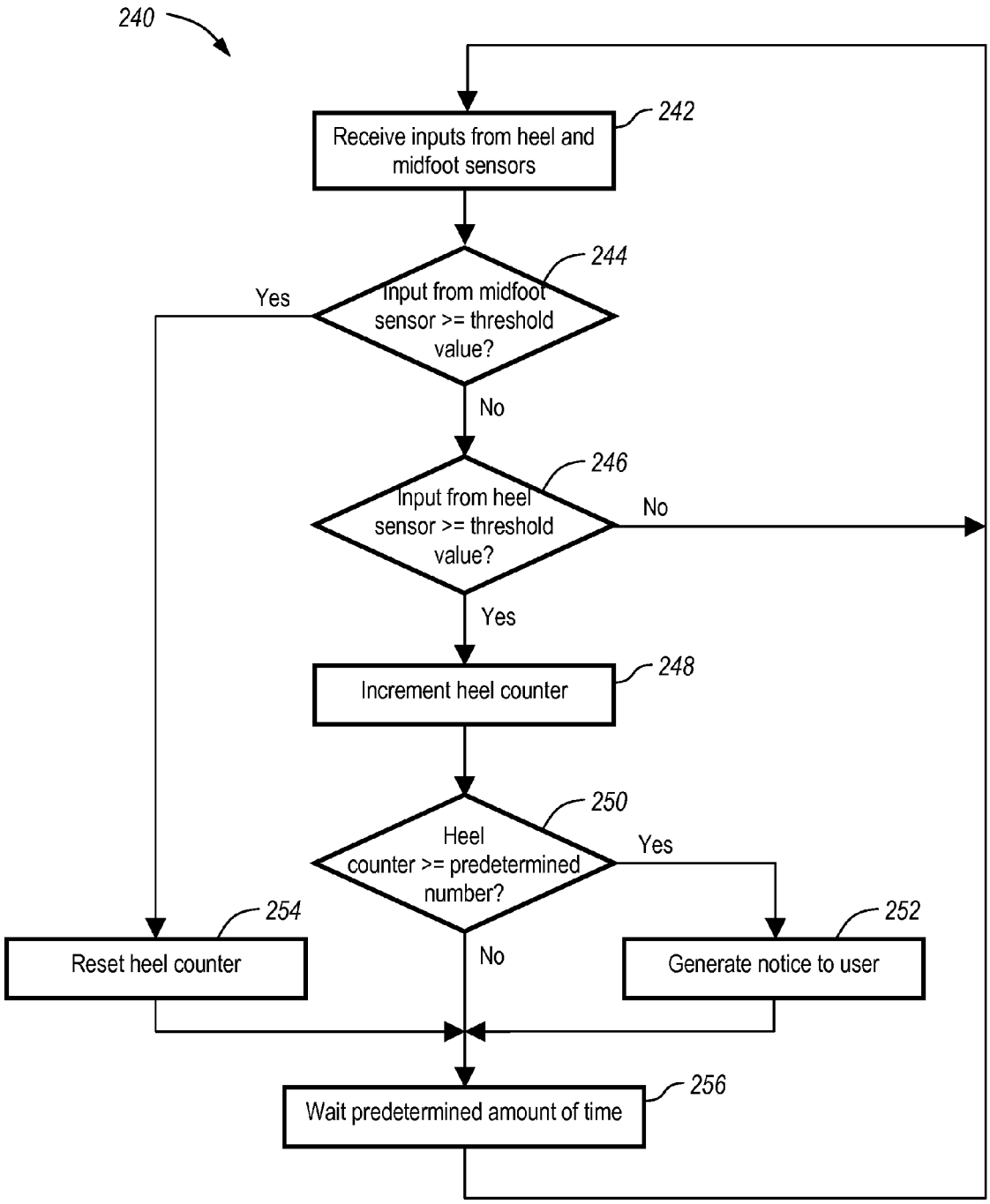
FIG. 6 is a block diagram of a method of monitoring running steps according to another embodiment.

FIGS. 4-6 show various methods of monitoring running steps that can be performed by step analyzing apparatuses according to embodiments of the present invention. Although discussed as three separate methods, many, if not all, of the method steps disclosed in the separate methods can be mixed and matched in the different methods depending on the desired outcome.

Furthermore, various steps in the methods discussed herein include steps in which detected or computed values are compared against threshold or predetermined values. The threshold or predetermined values can be preset constant values that never change, or can be programmable values changeable by the user. In some embodiments, the processor can automatically set the value(s) based on variables such as the runner's weight, type of stride, etc. For example, in one embodiment a short training run can be made to come up with one or more of the predetermined values. This may be desirable if different runners share a system or if the system is used in different shoes by the same runner.

For ease in discussion, the methods will be discussed in conjunction with step analyzing apparatus 102, as described above, such that the steps of the method can be performed by processor 124. It should be noted, however, that this is exemplary only and that the methods discussed herein can be performed in conjunction with other step analyzing apparatuses if desired. To perform the methods discussed below, the step analyzing apparatus is first positioned within the runner's shoe so that sensors are positioned under the heel and midfoot of the runner's foot and then turned on. As noted above, in some embodiments system activator 136 is used to manually turn the step analyzing apparatus on and off. In other embodiments, step analyzing apparatus 102 can turn on and off automatically by, e.g., periodically monitoring shoe activity and turning on when a particular trigger occurs, such as one or more forceful contacts with a surface. Other system "wake-up" triggers are also possible.

With reference to FIG. 4, one method 200 of monitoring running steps is shown. At step 202, the step analyzing apparatus determines when a running step has begun or is presently occurring. This can be accomplished, e.g., by processor 124 monitoring the heel and midfoot sensors 110*a* and 110*b* to determine when a sufficient force is detected on either sensor to signify that contact with the ground has occurred. Various manners of doing this are discussed in more detail in the methods below. Once it has been determined that a running step is occurring, the method continues to step 204.

At step 204, the step analyzing apparatus determines, for the present running step, the order in which the heel and the midfoot of the shoe contact the ground. This can be accomplished, e.g., by processor 124 comparing the values of heel and midfoot sensors 110*a* and 110*b* to determine which sensor has detected contact with the ground first. Various manners of doing this are discussed in more detail in the methods below. It is noted that in some running styles, the heel does not contact the ground. For example, during runs up steep grades, the heel does not usually touch the ground. Embodiments of the present invention can account for this, as discussed below. Once it has been determined which portion of the shoe has contacted the ground first, the method continues to step 206.

At step 206, the step analyzing apparatus can notify the runner depending on the outcome of step 204. For example, if the heel is deemed to have contacted the ground first, the runner can be notified accordingly. This can be accomplished, e.g., by processor 124 activating indicator 118, as discussed above. The length of the notification can be whatever length is desired. For example, the notification can last substantially less than a second (a w microsecond, a millisecond, etc), about a second, until the next step occurs, or any other desired length of time. The signal can be a continuous or non-continuous signal, such as a pulsed signal. If the midfoot is deemed to have contacted the ground first, the notification can be omitted.

After the notification is given (if required) or it has been deemed that notification is not required, the method loops back to step 202 to determine when the next running step occurs. Thus, as shown in the depicted embodiment, once method 200 begins, the method can run in a continuous loop, repeating steps 202, 204, and 206 for each running step until the method is manually or otherwise stopped.

Based on the above, in one method of monitoring running steps, the method can comprise: sensing through a first sensor when a heel of a foot wearing a shoe causes a heel of the shoe to land against a surface; sensing through a second sensor when a midfoot of the foot wearing the shoe causes a midfoot of the shoe to land against the surface; processing, through an electrical processor, inputs from the first sensor and the second sensor to determine, for a given step of the shoe, whether the heel of the shoe is landing on the surface prior to the midfoot of the shoe; and activating an indicator to generate a notice if, for the given step, the heel of the shoe lands prior to the midfoot of the shoe.

In some cases, the runner may not want to be notified on every heel-first step. For example, FIG. 5 depicts one method 220 of monitoring running steps in which the runner is notified only if a predetermined number of consecutive heel-first steps have occurred.

At step 222, the processor continuously receives and analyzes inputs from the heel and midfoot sensors. At some point during the receipt and analysis of the sensor inputs, the processor determines from the sensor inputs that the heel and/or midfoot of the shoe has contacted or landed against a surface, as reflected in step 224. The receipt and analysis of the sensor inputs (steps 222 and 224) can be accomplished in a number of ways. For example, an interrupt or a polling approach can be used.

In the interrupt approach, both sensors can be used as interrupt triggers, as is known in the art, to interrupt the processor when a particular sensor threshold level has been detected. For switch type sensors, the interrupt triggering level can be set to trigger when the sensor switches "on". For tactile type sensors, the interrupt triggering level can be set to trigger when the detected force or pressure is at or above a predetermined threshold value. One benefit of using the interrupt approach is that the processor can be performing other tasks while waiting because the processor will automatically be interrupted by the interrupt triggers.

In the polling approach, the processor reads the sensor values in a periodic, continuous loop until the processor detects that at least one of the sensor values is at or above a predetermined threshold value. Similar to the sensor threshold level of the interrupt approach, the predetermined threshold value can be set based on the type of sensor used so that the processor detects when the sensor switches "on" for switch type sensors or when the detected force or pressure is at or above a predetermined threshold value for tactile type sensors. Using the polling approach, the processor is actively involved in processing the sensor values. As such, the processor may not be able to perform many other tasks at the same time. In either approach, the sensor inputs are used to determine which portion of the shoe has contacted the surface.

As noted above, in some running styles, the heel does not contact the ground. However, in those running styles, the midfoot always contacts the ground. Thus, even when the heel does not contact the ground, the running step will still be detected. Once it has been determined based on the sensor inputs that either the heel or the midfoot of the shoe has contacted the ground, the method continues to step 226.

At step 226, the processor determines, for the present running step, which portion of the shoe contacted the ground first. This can be accomplished by determining which sensor allowed the processor to determine that the shoe had landed against the surface. For example, in the interrupt approach, the processor can determine which sensor input caused the interrupt to occur. In the polling approach, the processor can determine which sensor input value was at or above the predetermined threshold value. The portion of the shoe associated with the triggering sensor has contacted the surface first. If the heel of the shoe is determined to have contacted the ground first, the method branches to step 228; otherwise the method branches to step 232.

At step 228, the processor compares the number of consecutive steps in which the heel has landed first ("heel-first steps") with a predetermined number. This can be done, e.g., using a counter, as discussed in more detail below. If the number of consecutive heel-first steps is greater than or equal to the predetermined number, the method branches to step 230; otherwise, the method branches to step 232.

At step 230, the step analyzing apparatus notifies the runner that the heel of the shoe has contacted the ground before the midfoot for at least the predetermined number of consecutive steps. The predetermined number can be any integer desired by the runner. For example, the predetermined number of consecutive steps can be 2, 3, 4, 5, 10, or any other desired integer. In some embodiments, the predetermined number is variable and can be changed by the runner before or during use of the step analyzing apparatus. In some embodiments, the predetermined number can change dynamically based on factors that occur during running, such as the gait of the runner, the elapsed time of the running session, etc. Once notice has been given to the runner, the method continues to step 232.

As noted above, the method also branches to step 232 if, at step 228, the number of consecutive heel-first steps is less than the predetermined number, or, at step 226, the midfoot of the shoe is determined to have contacted the ground first. As a result, in those cases, the notification step (step 230) is skipped.

At step 232, the processor waits for a predetermined period of time to allow the present running step to be completed. After the predetermined period of time has expired, the method returns to step 222 to begin monitoring for the next running step. The waiting period may be needed to allow the present running step to be completed; otherwise, the end of the present running step may be detected in the next steps 222 and 224 and may be erroneously seen as the next running step.

The predetermined waiting period can be any time period that: i) is long enough to allow the present running step to conclude and ii) is short enough so that the next running step does not occur before the method returns to step 222. For example, the predetermined waiting period can be between about 0.1 seconds and 0.5 seconds with between about 0.1 seconds and 0.3 seconds being common. In some embodiments, the predetermined waiting period varies based on the running pace or other variable. In some embodiments, the running step concludes before the method steps are all performed, thereby making the waiting period unnecessary. In other embodiments, step 232 can be optional depending on the speed of the processor and the gait of the runner, among other things. In embodiments where the waiting period is unnecessary or otherwise undesired, step 232 can be omitted and monitoring of the next running step (step 222) can begin immediately after completion of steps 226, 228, and/or 230.

Based on the above, in one method of monitoring running steps, the method being performed by a processor positioned in a shoe, the method can comprise: repeating for each running step the following: receiving inputs from a first sensor and a second sensor, the first sensor being configured to indicate when a heel of a foot wearing the shoe causes a heel of the shoe to land against a surface and the second sensor being configured to indicate when a midfoot of the foot wearing the shoe causes a midfoot of the shoe to land against a surface; determining, based on the inputs, when a first one of the heel or the midfoot of the shoe has landed against a surface, and which portion of the shoe has landed first; outputting a signal to an indicator to generate a notice if, including the present running step, the number of consecutive running steps the heel of the shoe has landed first is greater than or equal to a predetermined number; and waiting and ignoring the inputs for a predetermined period of time.

FIG. 6 depicts another method 240 of monitoring running steps in which the runner is notified only if a predetermined number of consecutive heel-first steps have occurred. A heel counter is used to determine when this has occurred. Method 240 uses the polling method, discussed above, to receive and monitor inputs from the heel and midfoot sensors.

At step 242, the processor receives an input from each of the heal and midfoot sensors and the method continues to step 244.

At step 244, the value from the midfoot sensor is compared against a first predetermined threshold value. If the midfoot sensor input value is less than the first predetermined threshold value, the midfoot of the shoe is not landing on the ground and the method continues to step 246.

At step 246, the value of the input from the heel sensor is compared against a second predetermined threshold value. If the heal sensor input value is less than the second predetermined threshold value, the heel of the shoe is not landing the ground and the method loops back to step 242. The first and second predetermined threshold values can be the same or different, depending on the types of sensors used, the expected forces encountered, etc. Furthermore, steps 242, 244, and 246 can be used with switch types of sensors or tactile types of sensors, in the manner discussed above.

The method loop (steps 242, 244, 246) continues until the value of one of the sensor inputs becomes greater than or equal to the respective predetermined threshold value at step 244 or 246. As such, steps 242, 244, and 246 combine to disclose one way of accomplishing steps 222 and 224 of method 220, discussed above.

At step 244, if the value from the midfoot sensor is greater than or equal to the first predetermined threshold value, the midfoot portion of the shoe has contacted the ground first and the method branches to step 254. Because this is the desired result, no signal is sent to the runner. Furthermore, because the midfoot portion of the shoe has contacted the ground first, the number of consecutive heel-first running steps is now zero.

At step 254, the heel counter is reset to reflect the reset of the number of consecutive heel-first running steps, and the method continues to step 256 to wait before beginning to monitor the next running step.

At step 246, if the value from the heel sensor is greater than or equal to the second predetermined threshold value, the heel portion of the shoe has contacted the ground first and the method branches to step 248.

At step 248, because the heel portion of the shoe has contacted the ground first, the number of consecutive heel-first running steps has increased by one. The heel counter is accordingly incremented. The method then continues to step 250.

At step 250, the heel counter (which represents the number of consecutive heel-first steps) is compared with the predetermined number. If the heel counter is greater than or equal to the predetermined number, the number of heel-first steps has occurred for at least the predetermined number of consecutive steps. If the heel counter is greater than or equal to the predetermined number, the method branches to step 252; otherwise the method branches to step 256.

At step 252, the step analyzing apparatus notifies the runner that the heel of the shoe has contacted the ground before the midfoot for at least the predetermined number of consecutive steps. The predetermined number can be any number discussed above with respect to method 220. Once notice has been given to the runner, the method continues to step 256.

As noted above, the method also branches to step 256 if, at step 244, the midfoot of the shoe is determined to have contacted the ground first, or, at step 250, the number of consecutive heel-first steps is less than the predetermined number. As a result, in those cases, the notification step (step 252) is skipped.

At step 256, the processor waits for a predetermined period of time to allow the present running step to be completed. After the predetermined period of time has expired, the method returns to step 242 to begin monitoring for the next running step. The predetermined period of time can be any time period discussed above with respect to method 220. Furthermore, the waiting period can be omitted if desired as also discussed above with reference to method 220. For example, in some embodiments, step 256 can be omitted and monitoring of the next running step (step 242) can begin immediately after completion of steps 250, 252, and/or 254.

The methods discussed above use inputs from two sensors, one at the heel and one at the midfoot, to monitor the running step and alert the runner, when desired. In other embodiments, a single sensor can be used. For example, if a single sensor is used, the sensor can be positioned under the heel. During a running step, if the heel strikes the ground first, a greater force is likely to occur there. Therefore, the processor can monitor the heel sensor and if a great enough force is detected therefrom, the step analyzing apparatus can signal the user that an undesired step has occurred.

Figure 7:
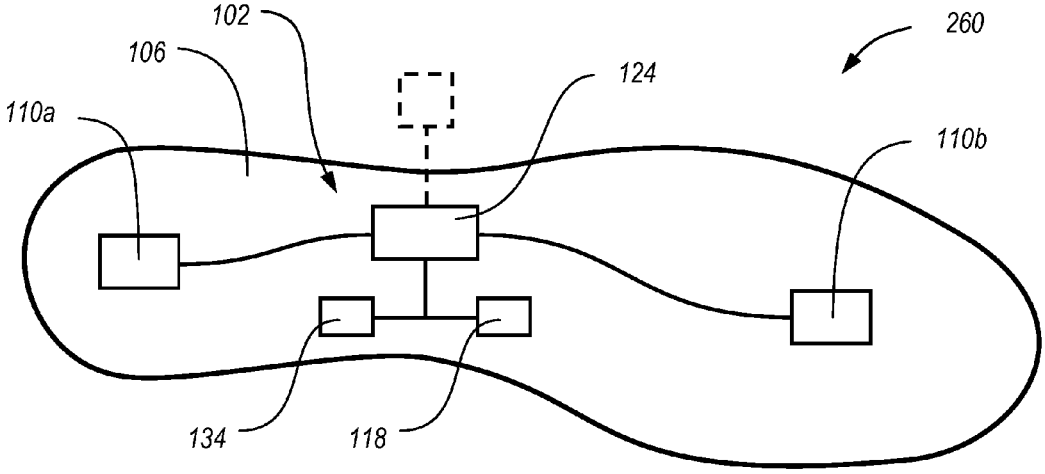
FIG. 7 is a top schematic view of an insole with a step analyzing apparatus mounted thereon, according to one embodiment.
Figure 8:
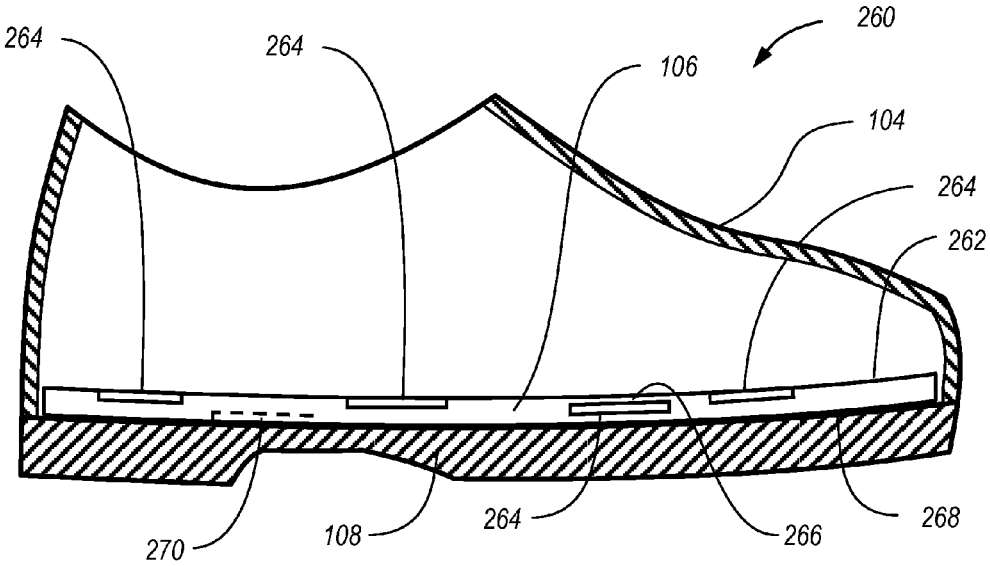
FIG. 8 is a cross sectional side view of the insole shown in FIG. 7 positioned within a shoe.

FIGS. 7 and 8 depict another system 260 for monitoring running steps according to one embodiment. System 260 is similar to system 100 except that instead of most of the components of step analyzing apparatus 102 being mounted on substrates 138, the components of step analyzing apparatus 102 are mounted directly on the top surface 262 of insole 106. For example, as shown in FIG. 7, sensors 110, processor 124, power source 134 and indicator 118 can all be mounted on insole 106. If analyzing apparatus 102 is automatically turned on and off so as to obviate the need for an external system activator as discussed above, the analyzing apparatus/insole combination can be a standalone unit. That is, by being mounted on insole 106, step analyzing apparatus 102 can be movable between shoes by simply removing insole 106 from one shoe and positioning insole 106 within another shoe.

As shown in FIG. 8, one or more cavities 264 can be formed on top surface 262 of insole 106 for receiving the mounted components. Cavities 264 may be beneficial so that the runner does not feel any discomfort from step analyzing apparatus 102. Cavities 264 can be of any depth desired. In one embodiment, the depth of cavities 264 is such that the tops of the mounted components of step analyzing apparatus 102 are flush with top surface 262 of insole 106. In another embodiment, the depth of one or more cavities 264 is such that the mounted components are completely recessed within cavities 264 so that a cover 266 can be positioned within each cavity 264 over the mounted components. Although disclosed herein as being mounted on top surface 262, one or more of the step analyzing apparatus components can instead by mounted on bottom surface 268 of insole 106. This may provide more comfort to the user. Similar to top surface 262, bottom surface 268 may also include cavities 270 formed thereon for receiving the components mounted thereon. In one embodiment, the cavities are formed within insole 106 so that once the components have been positioned within the cavities, the components are enclosed within the insole.

Figure 9:
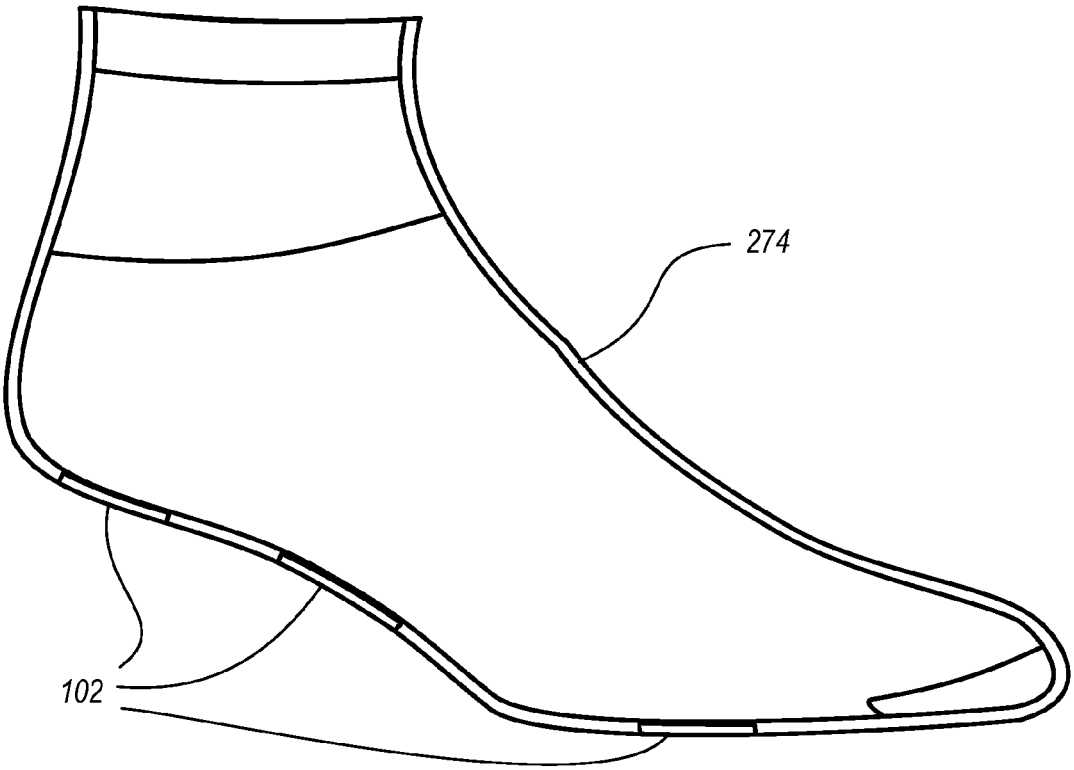
FIG. 9 is a cross sectional side view of a sock with a step analyzing apparatus mounted thereto.

FIG. 9 shows another embodiment in which step analyzing apparatus 102 can be easily moved between shoes. In the depicted embodiment, step analyzing apparatus 102 is incorporated within a sock 274. Similar to the other embodiments discussed herein, the heel and midfoot sensors 110*a* and 110*b* are respectively positioned to be directly under the heel and midfoot of the user. Step analyzing apparatus 102 can be positioned inside or outside of sock 274, such as by adhesive or stitching, or can be disposed between layers formed on the bottom of sock 274. Other mounting methods can also be used.

In contrast to being removable from or separately attachable to a shoe, step analyzing apparatus 102 can be secured sole 108 (FIG. 1) of a shoe as part of the manufacturing process of the shoe. For example, analyzing apparatus 102 can be molded into, i.e., embedded within, sole 108 or can be molded onto the top surface of sole 108.

Figure 10:
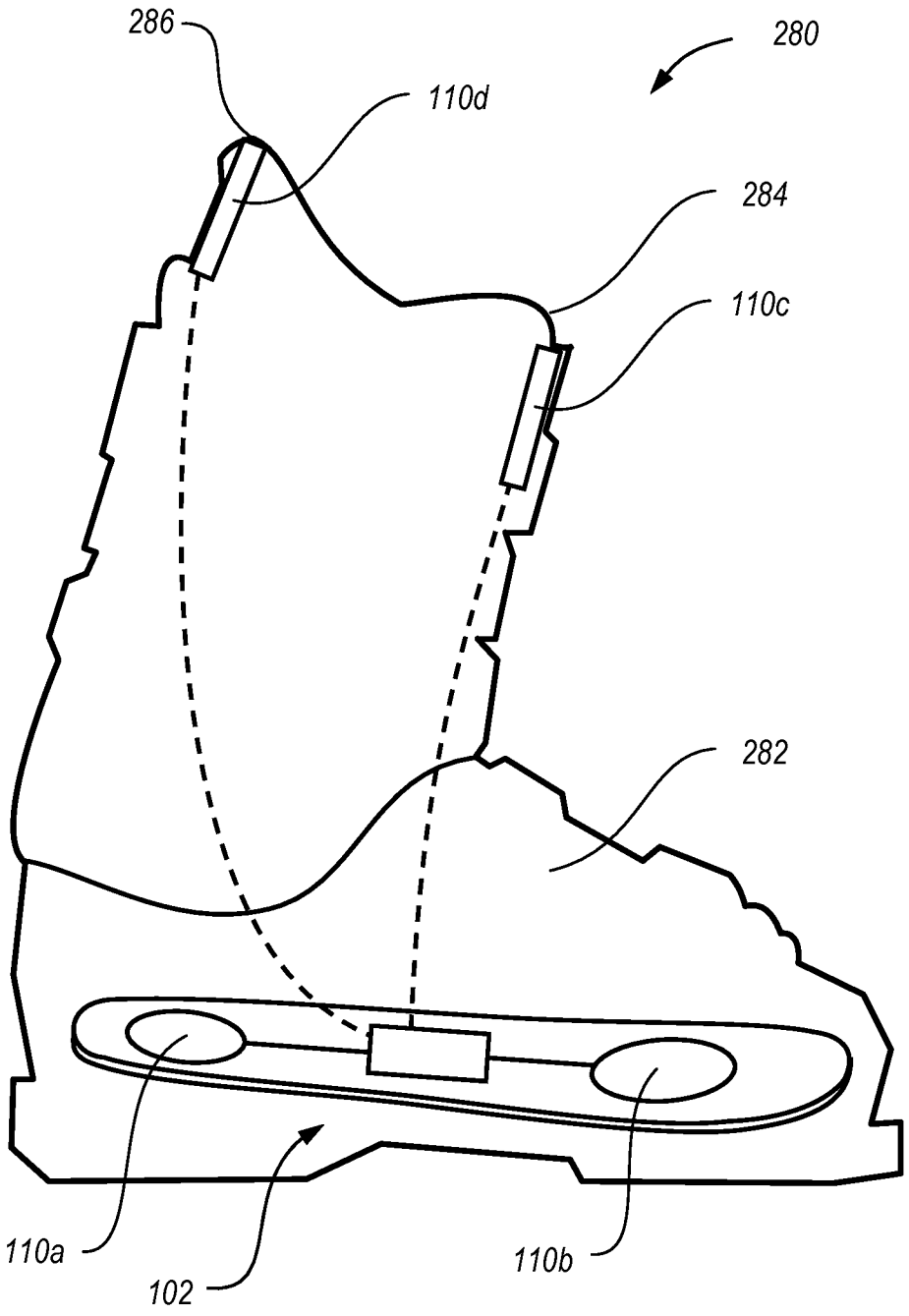
FIG. 10 illustrates a step analyzing apparatus positioned within a ski boot according to one embodiment.

Step analyzing apparatus 102 can also be used to help optimize an athlete's form in other types of athletic steps. For example, FIG. 10 shows a system 280 according to one embodiment that can be used for skiing or the like. Similar to the other systems discussed herein, system 280 can include step analyzing apparatus 102 to monitor heel and midfoot sensor inputs and signal the user when bad form is detected.

In skiing, a traditional running step is not typically used. However, the same type of concept regarding foot forces is used to determine proper ski form in a ski boot 282. Proper ski form typically requires all or most of the weight being placed on the front of the foot, such that the shin of the skier is pressed against a top front portion 284 of ski boot 282. As such, most of the weight of the foot should be centered over the midfoot. Therefore, similar to the methods discussed previously, the processor can monitor the values from midfoot and heel sensors 110*a* and 110*b* to determine proper weight placement, and signal the user when improper form is detected.

For example, in one embodiment, if midfoot sensor 110*b* indicates a release of foot pressure thereon and heel sensor 110*a* indicates an increase of foot pressure thereon for a predetermined period of time, such as, e.g., five or ten seconds, step analyzing apparatus 102 can signal the user in one of the manners discussed above. In another embodiment, heel sensor 110*a* can be the only sensor monitored. In that embodiment, a predetermined amount of force placed on the heel sensor can trigger the step analyzing apparatus 102 to signal the user.

In another embodiment, one or more sensors can be placed within the ski boot at other locations. The one or more other sensors can be used in place of or in conjunction with heel sensor 110*a* and/or midfoot sensor 110*b*. For example, as shown by the dashed lines in FIG. 10, sensors 110*c* and 110*d* can be respectively positioned at top front and rear portions 284 and 286 of ski boot 282 to align with the shin and calf of the user. Sensors 110*c* and 110*d* can be used alone or in conjunction with sensors 110*a* and 110*b* to determine proper and improper forces and pressures caused by the skier's leg and foot.

The systems disclosed herein can also be used to determine if the runner is running at a desirable cadence. Cadence is the tempo at which the runner is taking the running steps and usually constitutes the amount of steps taken for a particular unit of time, such as steps per minute. Thus, relatively speaking, at a faster cadence the runner is taking more steps per unit of time and therefore less time elapses between steps. Conversely, at a slower cadence the runner is taking less steps per unit of time and therefore more time elapses between steps. A runner may have a cadence range that is desirable to optimize power or speed, conserve energy, or optimizes some other aspect of running. For example, an efficient cadence may be 85-90 steps per foot per minute, or 170-180 total steps per minute. The systems disclosed herein can be used to determine if the runner is running within a predefined desirable cadence range.

Figure 11:
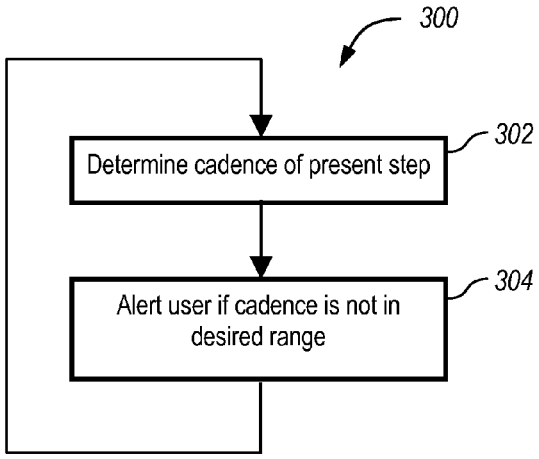
FIG. 11 is a block diagram of a method of monitoring cadence of a runner according to one embodiment.
Figure 12:
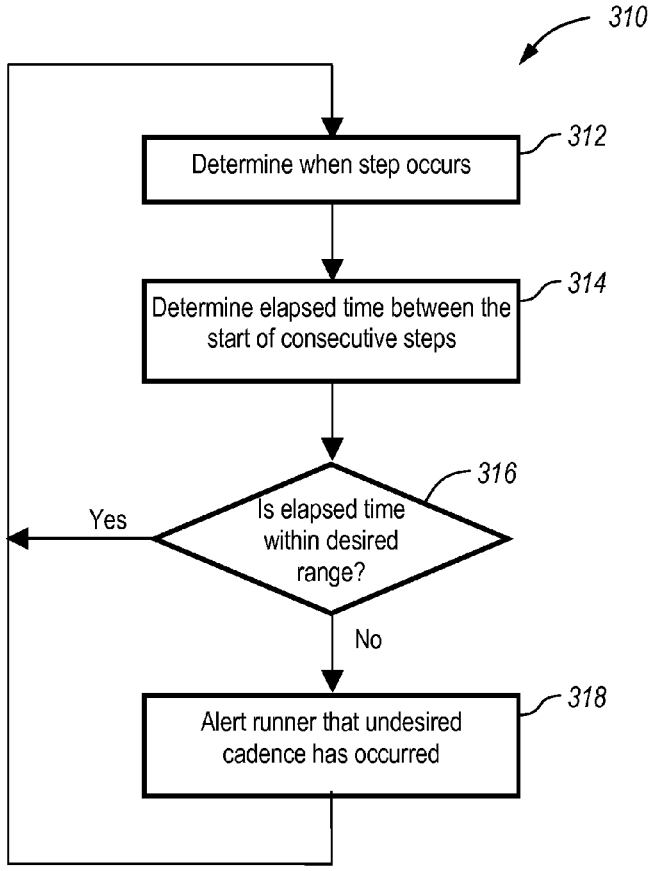
FIG. 12 is a block diagram of a method of monitoring cadence of a runner according to another embodiment.
Figure 13:
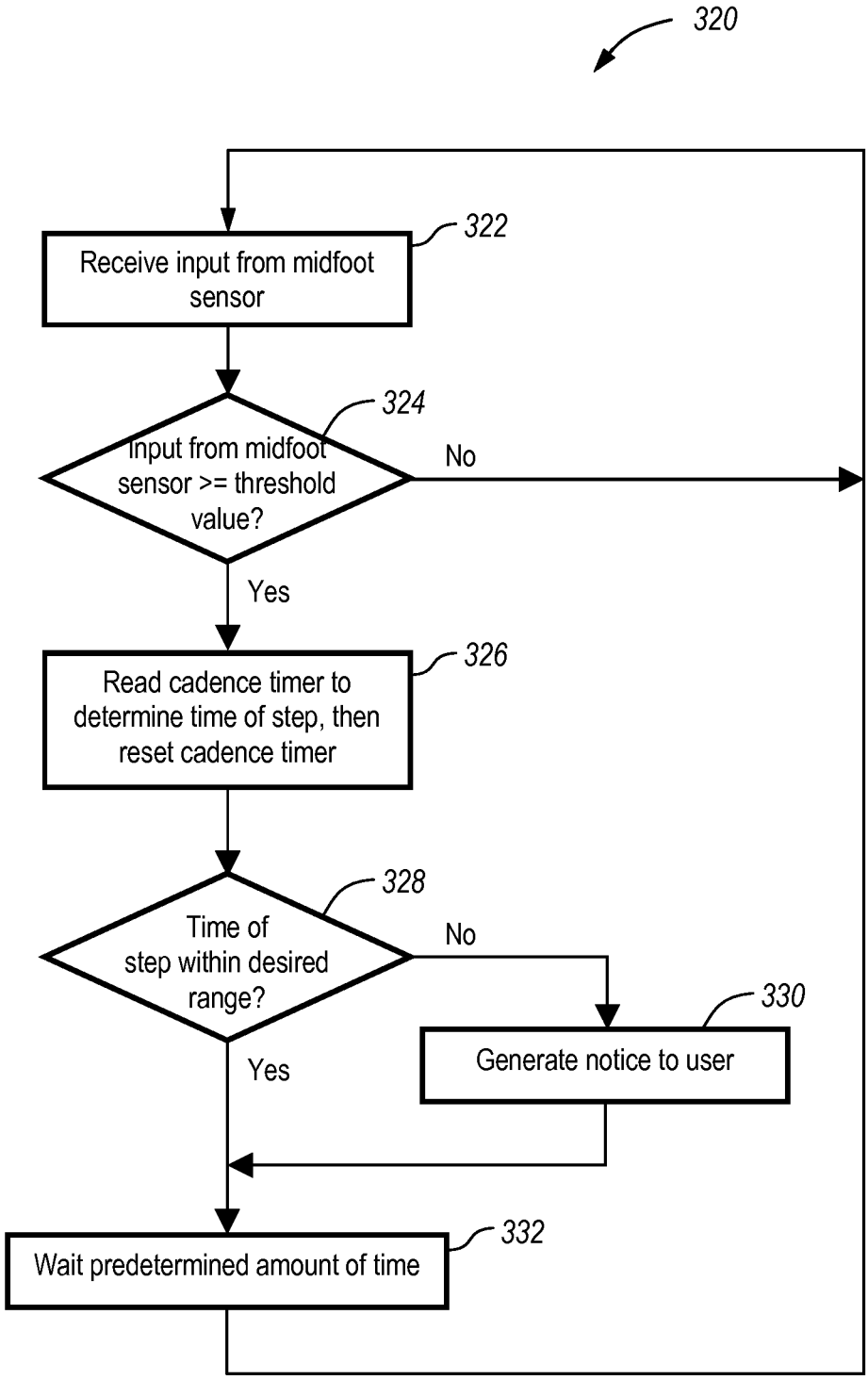
FIG. 13 is a block diagram of a method of monitoring cadence of a runner according to another embodiment.

For example, FIGS. 11-13 show various methods of monitoring running cadence that can be performed by step analyzing apparatuses according to embodiments of the present invention. Although discussed as three separate methods, many, if not all, of the method steps disclosed in the separate methods can be mixed and matched in the different methods depending on the desired outcome. Furthermore, any of the cadence monitoring methods can be performed concurrently with any of the running step monitoring methods, if desired.

With reference to FIG. 11, one method 300 of monitoring running cadence is shown. At step 302, the step analyzing apparatus determines the cadence of the present running step. This can be accomplished, e.g., by processor 124 determining when consecutive steps have taken place in one of the manners discussed above, and then determining the time between the steps. Because the detected steps are taken by the same foot, the cadence value will correspond to steps taken by the same foot. Thus, the steps taken by the opposite foot, which fall in between the detected steps, are not taken into account. If the cadence of all steps (i.e., of both feet) is desired, the detected cadence value can be divided in half. Once the cadence has been determined, the method continues to step 304.

At step 304, the determined cadence is compared with a desired range and the user is alerted if the determined cadence is outside of the desired range.

FIG. 12 depicts another method 310 of monitoring running cadence.

At step 312, the step analyzing apparatus determines when a present step has begun. Once the present step has been detected, the method continues to step 314.

At step 314, the step analyzing apparatus determines the elapsed time between the start of the prior step and the start of the present step and the method continues to step 316.

At step 316, the elapsed time determined in step 314 is compared to a desired time range corresponding to a desired cadence. For example, if the desired cadence range is 85-90 steps per foot per minute, then the elapsed time of the steps of the same foot would need to be between 667 and 706 milliseconds. If the elapsed time is within the desired time range, no alert is needed and the method loops back to step 312. If the elapsed time is not within the desired time range, the method branches to step 318, where the step analyzing apparatus notifies the runner that the cadence is not within the desired time range, before the method returns to step 312.

FIG. 13 depicts another method 320 of monitoring running cadence. Because the midfoot contacts the ground with every step, the midfoot sensor alone can be used to detect cadence. Therefore, method 320 only uses the midfoot sensor.

At step 322, the processor receives an input from the midfoot sensor and the method continues to step 324.

At step 324, the value from the midfoot sensor is compared against a predetermined threshold value. If the midfoot sensor input value is less than the predetermined threshold value, the midfoot of the shoe has not yet contacted the ground and the method loops back to step 322. The method loop (steps 322 and 324) continues until the value of the midfoot sensor input becomes greater than or equal to the predetermined threshold value at step 324. At step 324, if the value from the midfoot sensor is greater than or equal to the predetermined threshold value, the midfoot portion of the shoe has contacted the ground first and the method branches to step 326.

At step 326, the processor determines the elapsed time between the start of the prior running step and the present running step by using a cadence timer. The cadence timer is then reset for the next running step and the method continues to step 328.

At step 328, the elapsed time is compared to a desired time range corresponding to a desired cadence. If the elapsed time is within the desired range, no alert is needed and the method branches to step 332. If the elapsed time is not within the desired range, the method branches to step 330, where the step analyzing apparatus notifies the runner that the cadence is not within the desired range. Once the notification has occurred, the method then continues to step 332.

At step 332, the processor waits for a predetermined period of time to allow the present running step to be completed. After the predetermined period of time has expired, the method returns to step 322 to begin monitoring for the next running step. Step 332 is similar to step 232 of method 220, discussed above, and can have the same options and limitations as those discussed above.

Figure 14:
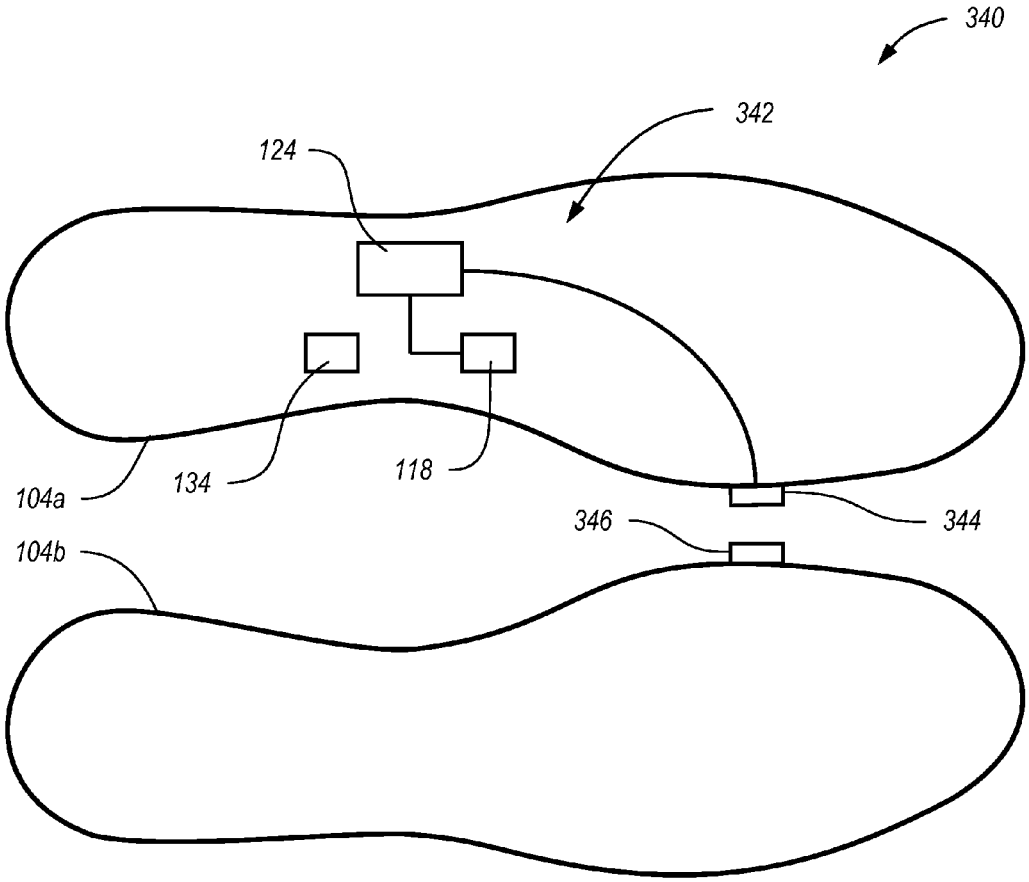
FIG. 14 is a top schematic view of a cadence analyzing apparatus according to one embodiment.

FIG. 14 illustrates another system 340 that can be used by method 320 to monitor cadence. System 340 includes a cadence analyzing apparatus 342 that can, similar to embodiments discussed above, alert the user when an undesired cadence is detected. As such, cadence analyzing apparatus 342 also includes indicator 118, processor 124 and power source 134. Similar to step analyzing apparatus 102, cadence analyzing apparatus 342 also includes a sensor 344 within the shoe 104*a* housing processor 124 and indicator 118. However, unlike sensors 310, sensor 344 is positioned on the side of shoe 104*a* closest to the runner's opposite shoe 104*b* and does not detect a force or pressure. Instead, sensor 344 is configured to detect a magnetic field.

A magnet 346 is mounted onto the side of the runner's shoe 104*b* that faces sensor 344 so as to pass by sensor 344 during the running step. As the runner runs, magnet 346 passes by sensor 344 at the same point during each running step. As magnet 346 passes by sensor 344, the magnetic field at sensor 344 increases and sensor 344 detects the passage of magnet 346 thereby. Method 320 can be used with magnet sensor with little, if any, modifications. As such, the cadence can be monitored and the user signaled when an undesirable cadence is detected by cadence analyzing apparatus 342. If desired, sensor 344 and magnet 346 can be added to step analyzing apparatus 102, if desired, to monitor the cadence concurrently with monitoring of the running step.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for monitoring running steps, the system comprising:

a shoe; and a step analyzing apparatus, comprising:

a first sensor located within the shoe, the first sensor being configured to transmit a first signal when a heel of a foot wearing the shoe causes a heel of the shoe to land against a surface;

a second sensor located within the shoe, the second sensor being configured to transmit a second signal when a midfoot of a foot wearing the shoe causes a midfoot of the shoe to land against a surface;

an indicator configured to generate a notice when activated; and a processor in electrical communication with the first sensor, the second sensor, and the indicator, the processor being configured to activate the indicator when the processor determines, based on the first and second signals, that for a given step of the shoe the heel of the shoe has landed prior to the midfoot of the shoe.

2. The system as recited in claim 1, wherein at least one of the first and second sensors comprises a tactile sensor that senses the amount of force or pressure generated thereagainst, the tactile sensor comprising one of the following: a transducer, a force sensor, a pressure sensor, and a strain gauge.

3. The system as recited in claim 1, wherein at least one of the first and second sensors comprises a switch that senses when a force or pressure greater than or equal to a predetermined amount is generated thereagainst, the switch comprising one of the following: a force switch, a pressure switch, and a gravity switch.

4. The system as recited in claim 1, wherein the indicator comprises one or more of the following: a vibrator, a speaker, and a visual display device.

5. The system as recited in claim 1, further comprising a transmitter and a receiver, wherein the indicator is wirelessly coupled to the processor via the transmitter and receiver.

6. The system as recited in claim 1, wherein the shoe comprises a sole and an insole overlying the sole, the first and second sensors and the processor being disposed between the insole and the sole.

7. The system as recited in claim 1, wherein the shoe comprises a sole, the first and second sensors and the processor being secured to the sole.

8. The system as recited in claim 1, further comprising an insole removably positioned within the shoe, the first and second sensors and the processor being mounted to the insole.

9. The system as recited in claim 1, further comprising a sock at least partially positioned within the shoe, the first and second sensors and the processor being mounted to the sock.

10. The apparatus as recited in claim 1, wherein the processor is configured to also activate the indicator when the processor determines, based on the first and second signals, that for a given step of the shoe the amount of time that has elapsed between the immediately preceding step of the shoe and the given step of the shoe is greater than a predetermined threshold value.

11. The system as recited in claim 1, wherein the processor is configured to activate the indicator when the processor determines, based on the first and second signals, that the heel of the shoe has landed prior to the midfoot of the shoe for a predetermined number of consecutive steps made by the shoe.

12. A method of monitoring running steps, the method comprising:

sensing through a first sensor when a heel of a foot wearing a shoe causes a heel of the shoe to land against a surface;

sensing through a second sensor when a midfoot of the foot wearing the shoe causes a midfoot of the shoe to land against the surface;

processing, through an electrical processor, inputs from the first sensor and the second sensor to determine, for a given step of the shoe, whether the heel of the shoe lands on the surface prior to the midfoot of the shoe; and activating an indicator to generate a notice if, for the given step, the heel of the shoe lands prior to the midfoot of the shoe and the heel of the shoe has landed prior to the midfoot of the shoe on a predetermined number of consecutive steps immediately preceding the given step.

13. The method as recited in claim 12, wherein sensing through the first sensor when the heel of the foot wearing the shoe causes the heel of the shoe to land against the surface comprises determining when an amount of force generated by the heel of the foot against the first sensor is greater than a predetermined threshold value.

14. The method as recited in claim 12, wherein sensing through the electrical second sensor when the midfoot of the foot wearing the shoe causes the midfoot of the shoe to land against the surface comprises determining when an amount of force generated by the midfoot of the foot against the second sensor is greater than a predetermined threshold value.

15. The method as recited in claim 12, wherein activating the indicator to generate the notice comprises activating a vibrator electrically coupled with the electrical processor.

16. The method as recited in claim 12, further comprising:

determining, by the electrical processor, the amount of time that elapses between the given step and the step immediately preceding the given step; and activating the indicator to generate a second notice if, for the given step, the amount of elapsed time is not within a predetermined range.

17. A method of monitoring running steps, the method being performed by a processor positioned in a shoe, the method comprising:

repeating for each running step:

receiving inputs from a first sensor and a second sensor, the first sensor being configured to indicate when a heel of a foot wearing the shoe causes a heel of the shoe to land against a surface and the second sensor being configured to indicate when a midfoot of the foot wearing the shoe causes a midfoot of the shoe to land against a surface;

determining, based on the inputs, when a first one of the heel or the midfoot of the shoe has landed against a surface, and which portion of the shoe has landed first;

outputting a signal to an indicator to generate a notice if, including the present running step, the number of consecutive running steps the heel of the shoe has landed first is greater than or equal to a predetermined number; and waiting and ignoring the inputs for a predetermined period of time.

18. The method of monitoring running steps as recited in claim 17, wherein outputting a signal to an indicator to generate a notice comprises:

incrementing a heel counter if the heel of the shoe has landed first;

outputting the signal to the indicator to generate the notice if the heel counter is greater than or equal to the predetermined number of consecutive running steps; and resetting the heel counter if the midfoot of the shoe has landed first.

19. The method as recited in claim 17, wherein at least one of the first and second sensors comprises a tactile sensor that senses the amount of force or pressure generated thereagainst by the foot, and the inputs received from the corresponding sensors comprise signals representative of the amount of force or pressure sensed by the tactile sensor.

20. The method as recited in claim 17, wherein at least one of the first and second sensors comprises a switch that senses when a force or pressure greater than a predetermined threshold value is generated thereagainst by the foot, and the inputs received from the corresponding sensors comprise signals indicating the presence or absence of the predetermined threshold value of force or pressure against the switch.

* * * * *